United States Patent [19]

Blaser et al.

[11] Patent Number: 5,029,835

[45] Date of Patent: Jul. 9, 1991

[54] METHOD AND DEVICE FOR CONVEYING SHEETS

[75] Inventors: Peter T. Blaser, Dielheim; Bertold Grützmacher, Schriesheim, both of Fed. Rep. of Germany

[73] Assignee: Heidelberger Druckmaschinen AG, Heidelberg, Fed. Rep. of Germany

[21] Appl. No.: 469,357

[22] Filed: Jan. 24, 1990

[30] Foreign Application Priority Data

Jan. 24, 1989 [DE] Fed. Rep. of Germany ..... 3901907

[51] Int. Cl.[5] ..... B65H 3/14

[52] U.S. Cl. ..... 271/98; 271/71; 271/195; 198/630; 406/89

[58] Field of Search ..... 271/5, 11, 12, 97, 98, 271/194, 195, 91, 93, 94, 95, 96, 99; 198/630; 406/89

[56] References Cited

U.S. PATENT DOCUMENTS

| | | | |
|---|---|---|---|
| 2,454,762 | 11/1948 | Belluche | 271/11 |
| 2,869,867 | 1/1959 | Backhouse | 271/12 X |
| 3,158,367 | 11/1964 | Tarbuck | 271/11 |
| 3,539,216 | 11/1970 | Forcier | 271/97 X |
| 3,938,800 | 2/1976 | Wirz . | |
| 3,994,488 | 11/1976 | Takenaka et al. | 271/98 |
| 4,142,661 | 3/1979 | Nettles et al. | 271/195 X |
| 4,591,140 | 5/1986 | Illig et al. . | |
| 4,699,369 | 10/1987 | Zirilli | 271/98 |

FOREIGN PATENT DOCUMENTS

| | | | |
|---|---|---|---|
| 48605 | 5/1986 | Fed. Rep. of Germany | 271/98 |

*Primary Examiner*—H. Grant Skaggs
*Assistant Examiner*—C. Drubick
*Attorney, Agent, or Firm*—Herbert L. Lerner; Laurence A. Greenberg

[57] ABSTRACT

A method of conveying sheets by displacing in a sheet-conveying direction an upermost sheet of a pile of sheets having a contact surface of given length includes linearly lifting the sheet at a trailing edge thereof, briefly opening periodically and successively suction-air openings disposed above the pile of sheets in the sheet-conveying direction so as to form a wave crest running through the sheet starting from the trailing edge thereof and moving the sheet a displacement distance in the sheet-conveying direction in a plane relative to a top surface of the pile of sheets. The displacement distance corresponds to an amount by which the length of the sheet contact surface is shortened by the formation of the wave crest. A device is also provided for performing the method.

12 Claims, 3 Drawing Sheets

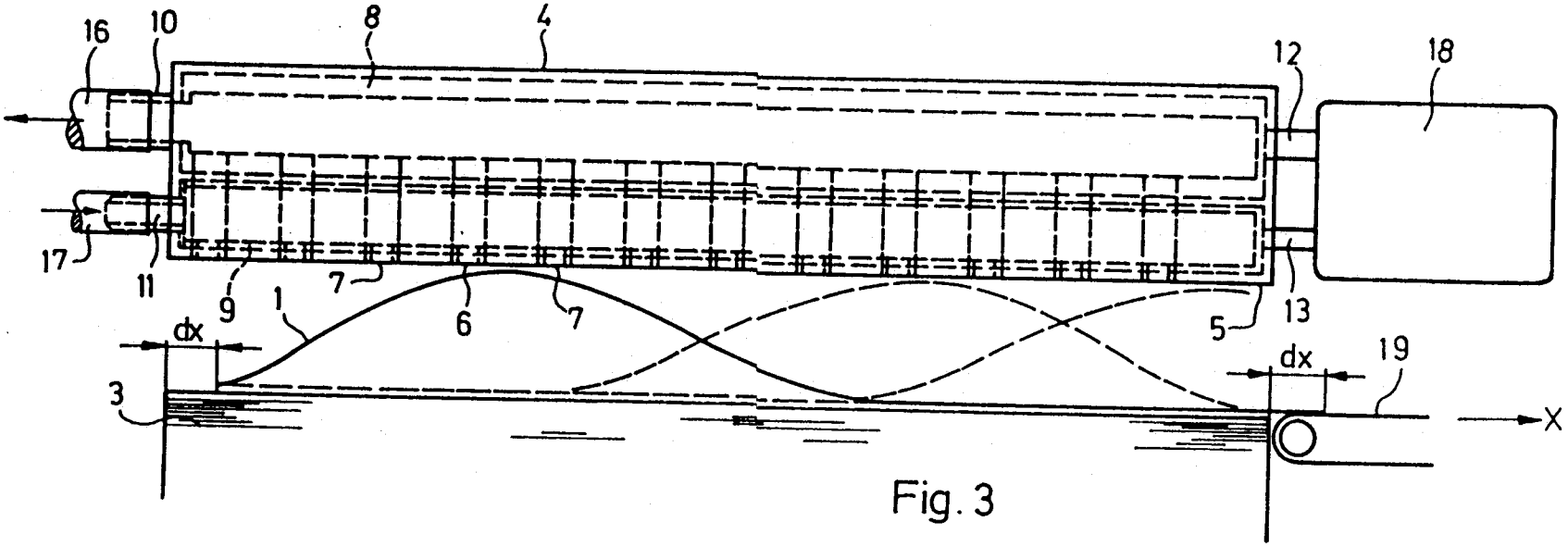
Fig. 3
Fig. 4
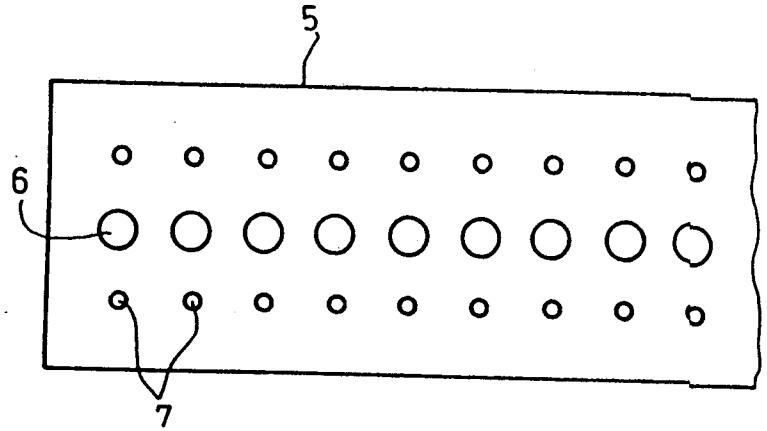

METHOD AND DEVICE FOR CONVEYING SHEETS

The invention relates to a method and device for conveying sheets, more particularly paper sheets, by displacing an uppermost sheet of a pile of sheets in a sheet-conveying direction.

Such devices have found use heretofore in feeders of sheet-fed printing presses. A heretofore known construction is that of a suction head described in U.S. Pat. No. 3,938,800.

This heretofore known device operates as follows: At the instant at which suction is applied to an uppermost sheet of the pile of sheets, the conveying means above the pile of sheets is supplied with suction air and, after a suitable conveying distance has been traversed, the suction means are disconnected from the suction air in order to pass the sheet on to a further conveying system. The conveying distance of the sheet is thus determined by the distance covered by the conveying means. Due to an idle stroke, which occurs after the end of an operating cycle, it is not possible for these heretofore known conveying means to operate continuously.

A problem encountered when operating the heretofore known suction head is in the removal of the uppermost sheet from the pile of sheets. Due to cohesion forces prevailing between the individual sheets, and due to electrostatic forces, the uppermost sheet can be lifted only if the upper layer of the pile of sheets is loosened by laterally applied blowing nozzles. Furthermore, because the suction head is directly set down on the uppermost sheet, an additional device must be provided to prevent double sheets from being sucked up and conveyed as a result of the suction having passed through the uppermost sheet.

A heretofore known device is described in U.S. Pat. No. 4,591,140, wherein a movable suction mouthpiece has taken up one or more sheets after it has been set down on the sheet pile, and periodically alternating phases of vacuum and pressure are then applied to the mouthpiece. By positioning the mouthpiece at an inclination to the force of gravity, a motion component in the sheet-conveying direction is imparted to the sheet during falling phases. Double sheets which have been taken up because the suction has passed through the upper sheet, are shaken or shucked off, as it were, due to the cyclical application of suction to the sheet and release of suction from the sheet so that it is permitted to fall, respectively, along the conveying path.

Although this heretofore known device permits greater reliability of separation and thus prevents the conveyance of double sheets, it does not solve the problem of how to lift the sheet from the pile of sheets without additional aids, such as loosening blowers.

It is accordingly an object of the invention to provide a method of conveying sheets in a direction toward further sheet conveying means, wherein heretofore occurring difficulties with respect to lifting the sheet without additional aids are avoided. Furthermore, it is an object of the invention to provide a device for performing the foregoing method in a relatively simple manner from a manufacturing viewpoint.

With the foregoing and other objects in view, there is provided, in accordance with the invention, a method of conveying sheets by displacing in a sheet-conveying direction an uppermost sheet of a pile of sheets having a contact surface of given length, which comprises linearly lifting the sheet at a trailing edge thereof, briefly opening periodically and successively suction-air openings disposed above the pile of sheets in the sheet-conveying direction so as to form a wave crest running through the sheet starting from the trailing edge thereof and moving the sheet a displacement distance in the sheet-conveying direction in a plane relative to a top surface of the pile of sheets, the displacement distance corresponding to an amount by which the length of the sheet contact surface is shortened by the formation of the wave crest.

The combination of two steps of the method permits a problem-free conveyance and a problem-free lifting of the sheet in a direction towards further sheet-conveying means. Because the suction-air openings are not directly set down on the sheet but are disposed in a fixed location above the sheet, the danger of sucking through the upper sheet and, thereby, of conveying double sheets is sharply reduced. The problem of lifting the sheet from the sheet pile is solved by not lifting the sheet over its entire contact surface simultaneously but rather by initially lifting it linearly at a trailing edge thereof so that as the advancing wave crest is formed, the sheet is always carried by an air cushion.

In accordance with another mode of the invention, the method includes varying suction-air strength through the openings for correspondingly varying the height of the wave crest relative to the sheet contact surface so as to determine thereby the displacement distance in the sheet-conveying direction, and varying the time required by the wave crest to run through the sheet from the trailing edge to the leading edge thereof for determining the rate at which the sheet is conveyed.

In accordance with a further mode of the invention, wherein the suction-air openings are formed in a conveying bar, the method includes periodically controlling air flow from blown-air openings also formed in the conveying bar in coordination with switching the suction-air openings for propagating the wave crest over the length of the sheet without permitting the sheet to come into contact with the conveying bar.

In accordance with an added mode of the invention, the method includes continuously applying a flow of blown air from all of the blown-air openings superimposed on a periodic opening and closing of the suction-air openings.

In accordance with an additional mode of the invention, the method includes switching the suction-air and blown-air openings in coordination so as to influence the construction of the wave shape and, thereby, the displacement distance in the sheet-conveying direction.

Accordingly, the result of an advantageous mode of the method according to the invention is that the displacement in the sheet-conveying direction is controllable by varying the height of the wave crest in relation to the length of the sheet contact surface.

The method according to the invention is advantageously developed further by the fact that the wave crest is kept hovering between the sheet pile and the conveying bar, as the wave crest spreads, due to coordinated control of the suction-air and blown-air openings. As a further development of the method provides, contact between the sheet and the conveying bar can be prevented by simultaneously applying blowing air through all of the blown-air openings so that a constant, relatively weak blown-air flow is superimposed on the periodic control of the suction-air openings. Both of the foregoing further developments of the method according to the invention ensure that the sheets are conveyed in a very gentle manner, the second of the foregoing further developments offering additionally the advantage that those sections of the sheet surface through which the wave crest has not yet passed are pressed against the contact or support surface. Likewise, due to a suitable combination of blown-air and suction-air, it is possible to control or influence the construction of the wave shape and, consequently, to influence the displacement of the sheet with respect to the sheet pile. In accordance with a further aspect of the invention, there is provided a device for conveying sheets by displacing an uppermost sheet of a pile of sheets in a sheet-conveying direction, comprising a fixed conveying bar disposed parallel to the sheet-conveying direction above the pile of sheets and extending over the length of a sheet and forming an underside of a girder section, the conveying bar being formed with air openings disposed linearly in the sheet-conveying direction, and a device for controlling the suction-air and blown-air openings so that they are briefly opened and closed again in succession in the sheet-conveying direction and so that, when the last opening of the linearly disposed openings is opened, the first opening of the linearly disposed openings is opened again, continuously. Control of the suction-air and blown-air openings of the conveying bar, which forms the underside of a girder section, can be effected by electrical, mechanical or pneumatic means.

In accordance with another feature of the device of the invention, valve tubes, respectively, are connected to continuously operating vacuum and pressure sources, the valve tubes being rotatably mounted in the girder section and having a helical slot-like valve channel formed therein, the valve channel being alignable, at varying locations during rotation thereof, with the suction-air and the blown-air openings, respectively, for connecting the respective openings to the respective vacuum and pressure sources.

In accordance with a further feature of the device of the invention, the valve channels, respectively, are helically wound through 360 degrees around the respective valve tubes.

In accordance with an added feature of the device of the invention, the valve tubes, respectively, have a drive shaft connected thereto, and a motor is included for driving the shaft, the motor having a rotational speed for determining a rate at which the sheets are conveyed.

Depending upon the intended purpose (whether for suction air or blown air), the respective valve tube is connected to a continuously operating vacuum or pressure source. By rotating the shaft attached to the valve tube, the valve channel is continuously brought into alignment in the sheet-conveying direction with the openings of the conveying bar which accordingly apply suction air or blown air, respectively. This construction permits a continuous mode of operation because, when the last opening at the end of the conveying bar opens, the first opening at the beginning of the conveying bar likewise opens again, thereby initiating the conveyance of the next sheet.

The shape of the continuous wave crest and, consequently the displacement of the sheet with respect to the sheet pile towards further conveying means are controllable by varying the diameters of the suction-air and the blown-air openings or by the width of the valve channel. The sheet-conveying rate is controlled in a relatively simple manner by the rotational speed of a motor which drives the shaft connected to the valve tube. Control occurs in synchronism with the clock or cyclical operation of the printing machine.

In accordance with an additional feature of the invention, the device, when used for conveying large-format sheets, includes at least another conveying bar disposed adjacent to the first-mentioned conveying bar, the respective openings in the conveying bars being openable and closable concurrently.

In accorance with another feature of the invention, the suction-air openings are disposed equidistantly in a row along the length of the conveying bar, and the blown-air openings are disposed along both sides of and parallel to the row of suction-air openings.

In accordance with a concomitant feature of the invention, the suction-air and the blown-air openings are, respectively, formed in rows in the conveying bar, the rows of openings, respectively, being switchable on and off, alternatively.

Other features which are considered as characteristic for the invention are set forth in the appended claims.

Although the invention is illustrated and described herein as embodied in method and device for conveying sheets, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 3 is a side elevational view of a preferred embodiment of the device of the invention illustrating the mode of operation thereof;

FIG. 4 is a top plan view of an embodiment of a conveying bar forming an underside of a girder section of the device of FIG. 3;

Figure 1:
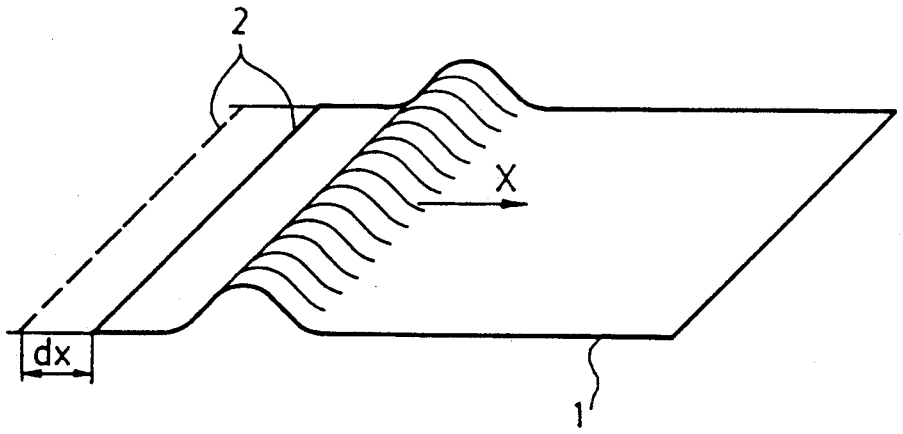
FIG. 1 is a diagrammatic top plan view of an instantaneous representation of a wave crest being propagated across a sheet.

The method according to the invention is explained hereinafter with respect to FIGS. 1 and 2, and FIGS. 3 to 7 present a preferred embodiment of the device according to the invention.

Like parts in the figures are identified by the same reference characters.

FIG. 1 is a top plan view of an instantaneous representation of a sheet having a trailing edge 2 which has been moved in a sheet-conveying direction x, a displacement distance dx with respect to its original position. After a wave crest has traversed the sheet 1, the latter has moved a displacement distance dx with respect to its original position, in the sheet-conveying direction x, the displacement distance dx corresponding to the extent by which the length of the contact or supporting surface of the sheets, i.e., that part of the undersurface of the sheet which is in supported contact with the next lower sheet of the pile, has been shortened by the formation of the wave crests. The displacement dx itself is dependent upon the height or amplitude and the shape of the wave crest.

Figure 2:
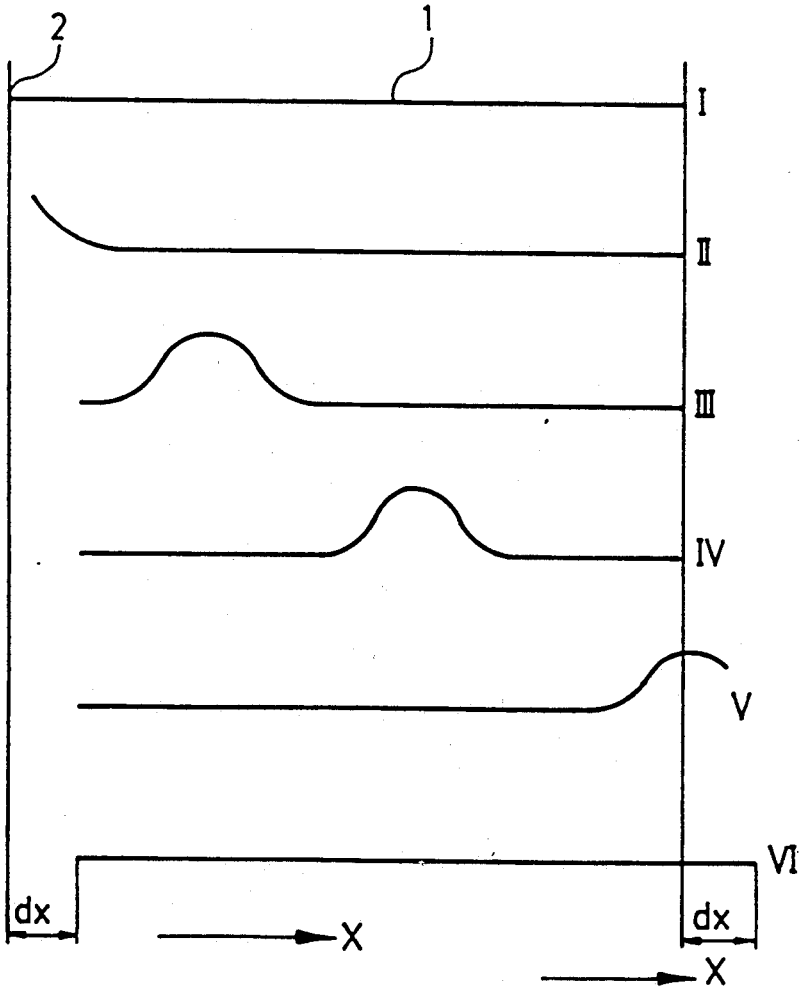
FIG. 2 is a side elevational view in a time sequence (I to VI) of instantaneous representations of a sheet which is traversed by a wave crest and thereby moved a displacement dx in sheet-conveying direction.

The individual phases of formation and propagation of the wave crest, by which the sheet 1 is moved a displacement dx in the sheet-conveying direction x, are illustrated as side elevational views in time sequence with reference to representations I to VI in FIG. 2. The sheet 1 lying on a base support (I) is raised linearly at the trailing edge 2 thereof (II) and then continuously in the sheet-conveying direction x, the trailing edge 2 of the sheet thereby again rests on the base support (III). The sheet-contact or support length is shortened with respect to the original sheet length, the extent of shortening dx being dependent upon the shape of the wave crest. The wave crest advances across the sheet until it reaches the leading edge (IV). When the wave crest runs out of the leading edge of the sheet (V), the sheet 1 lies down again on the base support, displaced, however, a displacement dx in the sheet-conveying direction x, the displacement dx corresponding to the extent of shortening of the sheet 1 by the formation of the wave crest.

The construction and the manner of operation of the inventive device is shown in FIG. 3.

FIGS. 4 to 7 illustrate the construction of a device which permits sheet transport or transfer by wave movement in a relatively simple mechanical manner which is minimally susceptible to trouble.

By means of the method of the invention described in detail hereinbefore, the sheet 1 is moved a displacement distance dx in the sheet conveying direction x and is taken over by a suction belt 19 for further conveyance. The device according to the invention is formed of a conveying bar 5, which is provided with rows of blown-air and suction-air openings 6 and 7. The conveying bar 5 forms the underside of a girder section 4 which is disposed above the sheet pile 3 and parallel to the sheet-conveying direction x.

As is shown separately in FIG. 4, the suction-air openings 6 lie equidistantly from one another in a row extending over the length of the conveying bar 5. The blown-air openings 7 are disposed on both sides of and parallel to the row of suction-air openings 6.

Figure 5:
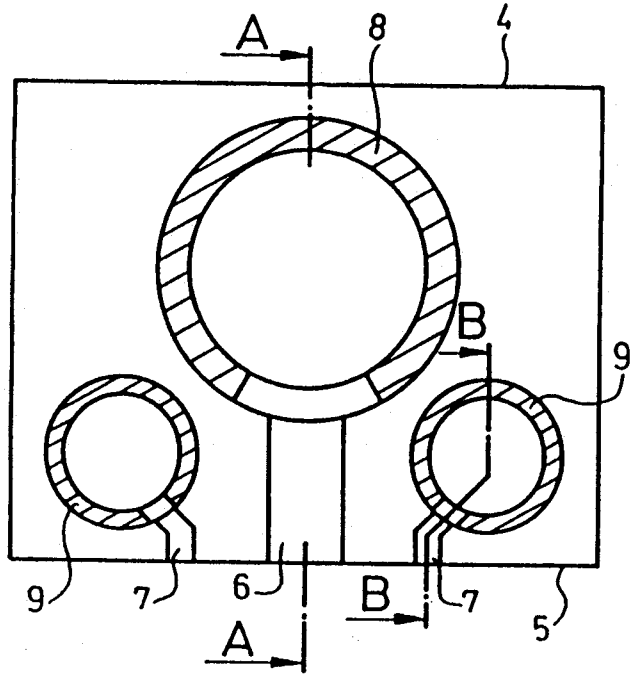
FIG. 5 is a cross-sectional view of a girder section enclosing valve tubes of the device.

FIG. 5 is a cross-sectional view of the girder section 4. Valve tubes 8 and 9 are rotatably mounted in the girder section 4 and extend in a longitudinal direction therein. The valve tubes 8 and 9 are driven in phase with the press by means of a motor 18 through the intermediary of shafts 12 and 13 disposed at end faces of the valve tubes 8 and 9. The jackets of the valve tubes 8 and 9 have helical valve channels 14 and 15 machined therein which describe one rotation of 360 degrees. The valve tube 8 is connected, at the other end thereof, via a suction nozzle 10 and via a line 16, to a non-illustrated vacuum source, while the valve tubes 9 are connected, via connecting nozzles 11 and lines 17, to a non-illustrated pressure source. Due to the rotation of the valve tubes 8 and 9, the valve channels 14 and 15 are continuously brought into alignment with the suction-air and blown-air openings 6 and 7 of the conveying bar 5, and are briefly connected successively to the vacuum and pressure sources, respectively, the row of suction-air and blown-air openings 6 and 7, respectively, being continuously passed through in the sheet-conveying direction x for each revolution of the valve tubes 8 and 9.

Figure 6:
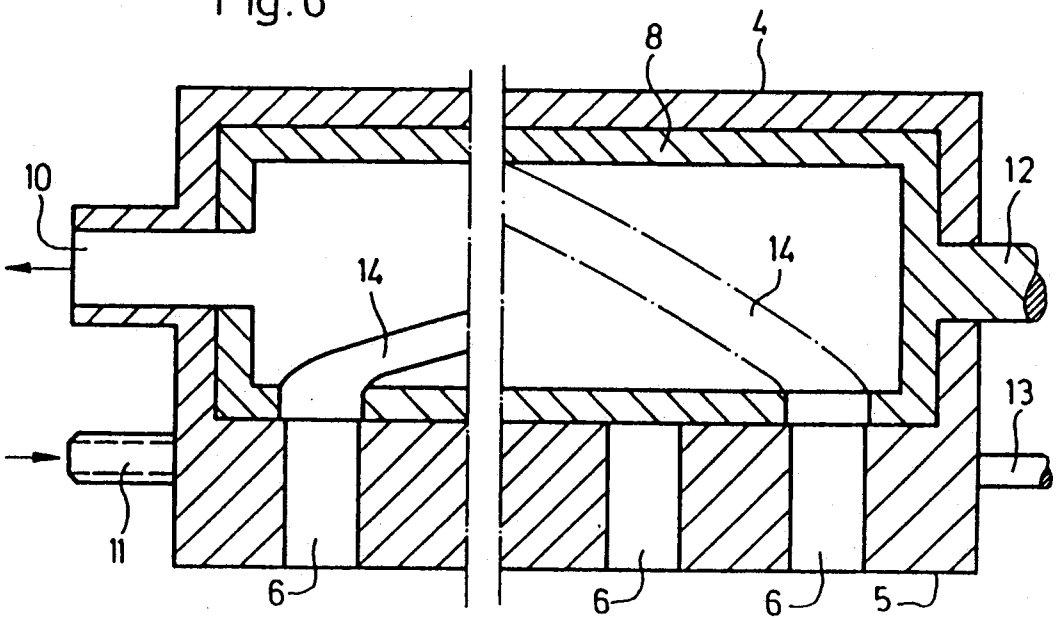
FIG. 6 is a longitudinal-sectional view of FIG. 5 taken in the direction of the arrows A—A.
Figure 7:
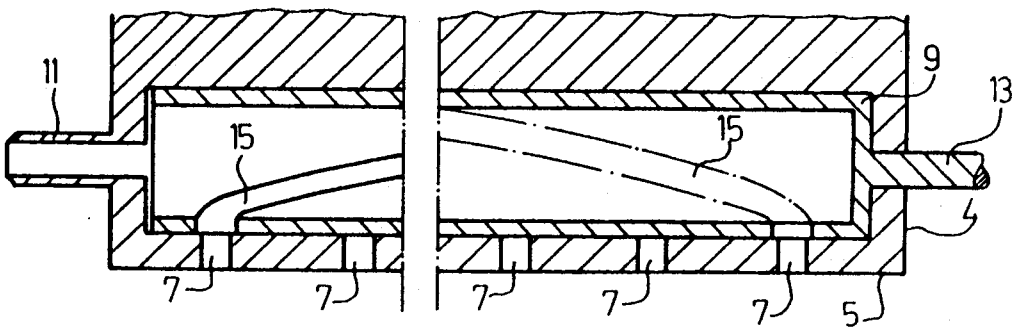
FIG. 7 is a fragmentary longitudinal-sectional view of FIG. 5 taken in the direction of the arrows B—B.

The longitudinal sectional views of FIGS. 6 and 7 defined by the lines AA and BB of FIG. 5 illustrate the continuous progress achieved by the mode of operation of the device according to the invention: when the last suction-air or blown-air opening 6 and 7, respectively, opens, the foremost opening is automatically opened again, as a result of which the next passage or traversal of the wave can be started and, consequently, the next sheet can be conveyed by means of a wave motion.

Whereas the switching of the suction-air openings 6 causes the conveyance of the sheet, the concurrent switching of the blown-air openings 7 produces an air cushion between conveying bar 5 and sheet 1, so that the sheet 1 is conveyed in a gentle manner, particularly in the case of perfector printing.

An advantage of this embodiment which assists the continuous mode of operation of this device is that a constant pressure prevails in the valve tubes 8 and 9 as well as in the lines 15 to the vacuum and pressure sources 16 and 17, respectively, so that when the corresponding suction-air or blown-air openings 6 and 7 are switched, changes in pressure occur only in the relatively small volumes of the openings themselves. Short pumping and venting times thereby result, so that rapid switching of the openings is possible.

The foregoing is a description corresponding in substance to German Application P No. 39 01 907.1, dated Jan. 24, 1989, the International priority of which is being claimed for this instant application, and which is hereby made part of this application. Any material discrepancies between the foregoing specification and the aforementioned corresponding German application are to be resolved in favor of the latter.

We claim:

1. Method of conveying sheets by displacing in a sheet-conveying direction an uppermost sheet of a pile of sheets having a contact surface of given length disposed in a given plane, which comprises linearly lifting the sheet at a trailing edge thereof, briefly opening periodically and successively suction-air openings disposed above the pile of sheets in the sheet-conveying direction so as to form a wave crest running through the sheet starting from the trailing edge thereof and moving the sheet a displacement distance in the sheet-conveying direction, while matintaining in the given plane the contact surface of substantially the entire sheet, except for the wave crest running therethrough, the displacement distance corresponding to an amount by which the length of the sheet contact surface is shortened by the formation of the wave crest.

2. Method according to claim 1, which includes continuously applying a flow of blown air from all of the blown-air openings superimposed on a periodic opening and closing of the suction-air openings.

3. Method of conveying sheets by displacing in a sheet-conveying direction an uppermost sheet of a pile of sheets having a contact surface of given length, which comprises linearly lifting the sheet at a trailing edge thereof, briefly opening periodically and successively suction-air openings disposed above the pile of sheets in the sheet-conveying direction so as to form a wave crest running through the sheet starting from the trailing edge thereof and moving the sheet a displacement distance in the sheet-conveying direction in a plane relative to a top surface of the pile of sheets, the displacement distance corresponding to an amount by which the length of the sheet contact surface is shortened by the formation of the wave crest, and which includes varying suction-air strength through the openings for correspondingly varying the height of the wave crest relative to the sheet contact surface so as to determine thereby the displacement distance in the sheet-conveying direction, and varying the time required by the wave crest to run through the sheet from the trailing edge to the leading edge thereof for determining the rate at which the sheet is conveyed.

4. Method of conveying sheets by displacing in a sheet-conveying direction an uppermost sheet of a pile of sheets having a contact surface of given length, which comprises linearly lifting the sheet at a trailing edge thereof, briefly opening periodically and successively suction-air openings disposed above the pile of sheets in the sheet-conveying direction so as to form a wave crest running through the sheet starting from the trailing edge thereof and moving the sheet a displacement distance in the sheet-conveying direction in a plane relative to a top surface of the pile of sheets, the displacement distance corresponding to an amount by which the length of the sheet contact surface is shortened by the formation of the wave crest, the suction-air openings being formed in a conveying bar, and which includes periodically controlling air flow from blown-air openings also formed in the conveying bar in coordination with switching the suction-air openings for propagating the wave crest over the length of the sheet without permitting the sheet to come into contact with the conveying bar.

5. Method according to claim 4, which includes switching the suction-air and blown-air openings in coordination so as to influence the construction of the wave shape and, thereby, the displacement distance in the sheet-conveying direction.

6. Device for conveying sheets by displacing an uppermost sheet of a pile of sheets in a sheet-conveying direction, comprising a fixed conveying bar disposed parallel to the sheet-conveying direction above the pile of sheets and extending over the length of a sheet and forming an underside of a girder section, said conveying bar being formed with air openings disposed linearly in the 18 sheet-conveying direction, and a device for controlling said suction-air and blown-air openings so that they are briefly opened and closed again in succession in the sheet-conveying direction and so that, when the last opening of said linearly disposed openings is opened, the first opening of said linearly disposed openings is opened again, continuously.

7. Device according to claim 6 for conveying large-format sheets, including at least another conveying bar disposed adjacent to the first-mentioned conveying bar, the respective openings in said conveying bars being openable and closable concurrently.

8. Device according to claim 6, wherein said suction-air openings are disposed equidistantly in a row along the length of said conveying bar, and said blown-air openings are disposed along both sides of and parallel to said row of suction-air openings.

9. Device according to claim 6, wherein said suction-air and blown-air openings are, respectively, formed in rows in said conveying bar, said rows of openings, respectively being switchable on and off, alternatively.

10. Device according to claim 6, including valve tubes, respectively, connected to continuously operating vacuum and pressure sources, said valve tubes being rotatably mounted in said girder section and having a helical slot-like valve channel formed therein, said valve channel being alignable, at varying locations during rotation thereof, with said suction-air and said blown-air openings, respectively, for connecting the respective openings to the respective vacuum and pressure sources.

11. Device according to claim 10, wherein said valve channels, respectively, are helically wound through 360 degrees around the respective valve tubes.

12. Device according to claim 10, wherein said valve tubes, respectively, have a drive shaft connected thereto, and including a motor for driving said shaft, said motor having a rotational speed for determining a rate at which the sheets are conveyed.

* * * * *